US009303586B2

(12) United States Patent
Yasukawa

(10) Patent No.: US 9,303,586 B2
(45) Date of Patent: Apr. 5, 2016

(54) BOAT PROPULSION DEVICE

(71) Applicant: YAMAHA HATSUDOKI KABUSHIKI KAISHA, Iwata-shi, Shizuoka (JP)

(72) Inventor: Hikaru Yasukawa, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 0 days.

(21) Appl. No.: 14/492,262

(22) Filed: Sep. 22, 2014

(65) Prior Publication Data

US 2015/0151820 A1 Jun. 4, 2015

(30) Foreign Application Priority Data

Nov. 29, 2013 (JP) ..... 2013-248485

(51) Int. Cl.
*B63H 20/00* (2006.01)
*F02F 7/00* (2006.01)
*F02B 61/04* (2006.01)

(52) U.S. Cl.
CPC ..... *F02F 7/0068* (2013.01); *F02B 61/045* (2013.01)

(58) Field of Classification Search
CPC ..... B63H 20/00
USPC ..... 440/49, 84–85
See application file for complete search history.

(56) References Cited

U.S. PATENT DOCUMENTS 4,089,290 A * 5/1978 Miles, Sr. ..... B63H 20/106 440/61 E
4,624,438 A * 11/1986 Goodman, Jr. ..... B63H 20/106 248/642
5,100,349 A * 3/1992 Perkins ..... B63H 20/10 248/641
5,171,174 A * 12/1992 Mynster ..... B63H 25/42 114/153
5,904,604 A * 5/1999 Suzuki ..... B63J 3/02 123/195 P
6,364,724 B1 * 4/2002 Nozawa ..... F02B 77/00 277/637
7,172,476 B2 * 2/2007 Nakamura ..... B63H 20/12 440/61 T
7,179,143 B2 * 2/2007 Mizuguchi ..... B63H 20/00 440/61 S
7,217,166 B2 * 5/2007 Fukuoka ..... F02B 61/045 440/77

(Continued)

FOREIGN PATENT DOCUMENTS

JP 2010-025004 A 2/2010

*Primary Examiner* — Lars A Olson
*Assistant Examiner* — Jovon Hayes
(74) *Attorney, Agent, or Firm* — Keating and Bennett, LLP

(57) ABSTRACT

A boat propulsion device includes an engine, a first bracket, and a first electric component. The engine includes a crankshaft extending in an up-and-down direction. The first bracket is fixed to the engine. The first electric component is attached to the first bracket. The first bracket includes a first support portion and a second support portion. The first support portion includes a first lateral surface and a second lateral surface. The first electric component is attached to the first lateral surface. The second lateral surface is arranged opposite to the first lateral surface. The second support portion is connected to the second lateral surface in a position spaced away from both ends of the second lateral surface in a top view. The second support portion includes a first coupling portion coupled to the engine.

8 Claims, 10 Drawing Sheets

(56) References Cited

U.S. PATENT DOCUMENTS

| | | | | |
|---|---|---|---|---|
| 7,241,194 | B2 * | 7/2007 | Tawa | B63H 20/12 440/53 |
| 7,363,908 | B2 * | 4/2008 | Chida | F02D 9/105 123/195 E |
| 8,016,625 | B2 * | 9/2011 | Suzuki | B63H 21/213 440/1 |
| 8,206,192 | B2 * | 6/2012 | Shiomi | B63B 39/061 440/66 |
| 8,419,488 | B2 * | 4/2013 | Ooshita | B63H 20/08 114/144 R |
| 8,944,868 | B2 * | 2/2015 | Kanno | B63H 20/10 440/1 |
| 2012/0097087 | A1 * | 4/2012 | Fisher | B63B 1/20 114/55.5 |
| 2013/0012080 | A1 * | 1/2013 | Yoshikawa | B63H 21/213 440/1 |
| 2015/0151820 | A1 * | 6/2015 | Yasukawa | F02F 7/0068 440/49 |

* cited by examiner

BOAT PROPULSION DEVICE

CROSS-REFERENCE TO RELATED APPLICATIONS

This application claims priority under 35 U.S.C. §119 to Japanese Patent Application No. 2013-248485, filed on Nov. 29, 2013. The entire disclosure of Japanese Patent Application No. 2013-248485 is hereby incorporated herein by reference.

BACKGROUND OF THE INVENTION

1. Field of the Invention

The present invention relates to a boat propulsion device.

2. Description of the Related Art

A boat propulsion device has been well-known so far that is equipped with an L-shaped bracket disposed along the outer peripheral surface of an engine (see Japan Laid-open Patent Application Publication No. JP-A-2010-25004). The L-shaped bracket is composed of a first support portion and a second support portion perpendicular to the first support portion. Electric components, including an ECU, a fuse box and so forth, are attached to a first outer surface of the first support portion. On the other hand, electric components, including a PTT relay, a main relay, a terminal and so forth, are attached to a second outer surface of the second support portion.

Regarding the L-shaped bracket described in Japan Laid-open Patent Application Publication No. JP-A-2010-25004, a space is provided between the engine and the bracket when either or both of the first and second support portions is/are extended sideward for enlarging an area to which the electric components are attached. However, a drawback occurs when the space produced between the engine and the bracket is externally inaccessible and is thus unsuitable for disposing the electric components and cables.

SUMMARY OF THE INVENTION

Preferred embodiments of the present invention disclosed herein disclosed have been conceived in view of the aforementioned situation. A preferred embodiment of the present invention provides a boat propulsion device equipped with a bracket that has a large area configured to attach an electric component and to produce an externally accessible space.

A boat propulsion device according to a preferred embodiment includes an engine, a first bracket, and a first electric component. The engine includes a crankshaft extending in an up-and-down direction. The first bracket is fixed to the engine. The first electric component is attached to the first bracket. The first bracket includes a first support portion and a second support portion. The first support portion includes a first lateral surface and a second lateral surface. The first electric component is attached to the first lateral surface. The second lateral surface is arranged opposite to the first lateral surface. The second support portion is connected to the second lateral surface at a position spaced away from both ends of the second lateral surface in a top view. The second support portion includes a first coupling portion coupled to the engine.

According to the present preferred embodiment, a boat propulsion device is equipped with a bracket that has a large space configured to attach an electric component and to produce an externally accessible space.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
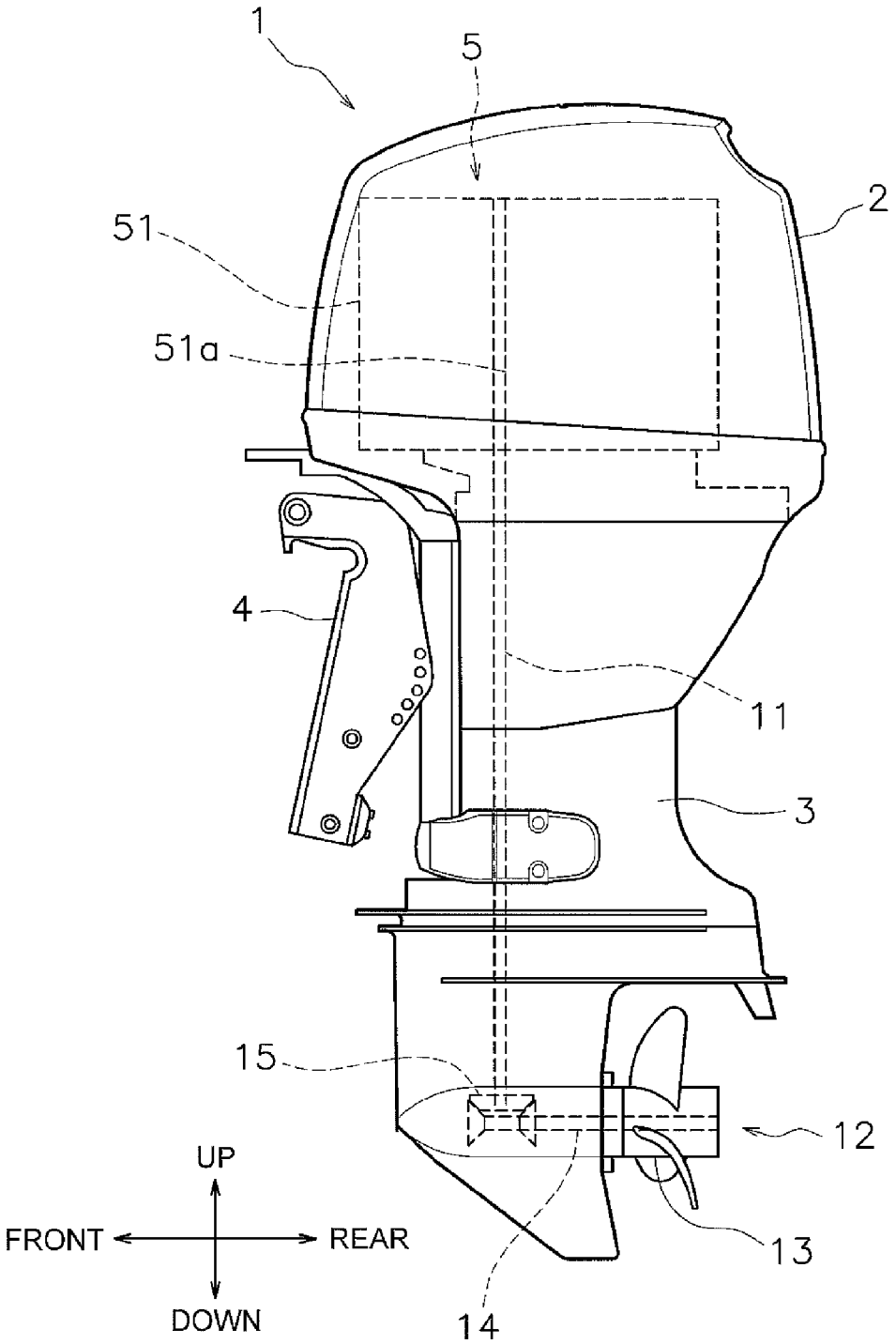
FIG. 1 is a side view of a boat propulsion device according to a preferred embodiment of the present invention.

With reference to the attached drawings, explanation will be hereinafter made for a boat propulsion device according to preferred embodiments of the present invention. FIG. 1 is a side view of a boat propulsion device 1 according to a preferred embodiment. The boat propulsion device 1 is preferably an outboard motor. The boat propulsion device 1 includes an engine cover 2, a casing 3, a bracket 4, and an engine unit 5. The engine cover 2 accommodates the engine unit 5. The casing 3 is disposed under the engine cover 2. The boat propulsion device 1 is attached to a vessel body through the bracket 4.

The engine unit 5 is disposed within the engine cover 2. The engine unit 5 includes an engine 51. A drive shaft 11 is disposed within the casing 3. The drive shaft 11 extends within the casing 3 in an up-and-down direction. The drive shaft 11 is fixed to a crankshaft 51*a* extending within the engine 51 in the up-and-down direction. A propeller 12 is disposed in the lower portion of the casing 3. The propeller 12 is disposed under the engine 51. The propeller 12 includes a propeller boss 13. A propeller shaft 14 is disposed inside the propeller boss 13. The propeller shaft 14 is disposed along a back-and-forth direction. The propeller shaft 14 is coupled to the lower portion of the drive shaft 11 through a bevel gear 15.

In the boat propulsion device 1, a driving force generated by the engine 51 is transmitted to the propeller 12 through the drive shaft 11 and the propeller shaft 14. The propeller 12 is thus configured to be forwardly or reversely rotated. As a result, this rotation generates thrust to forwardly or backwardly propel the vessel body to which the boat propulsion device 1 is attached.

Figure 2:
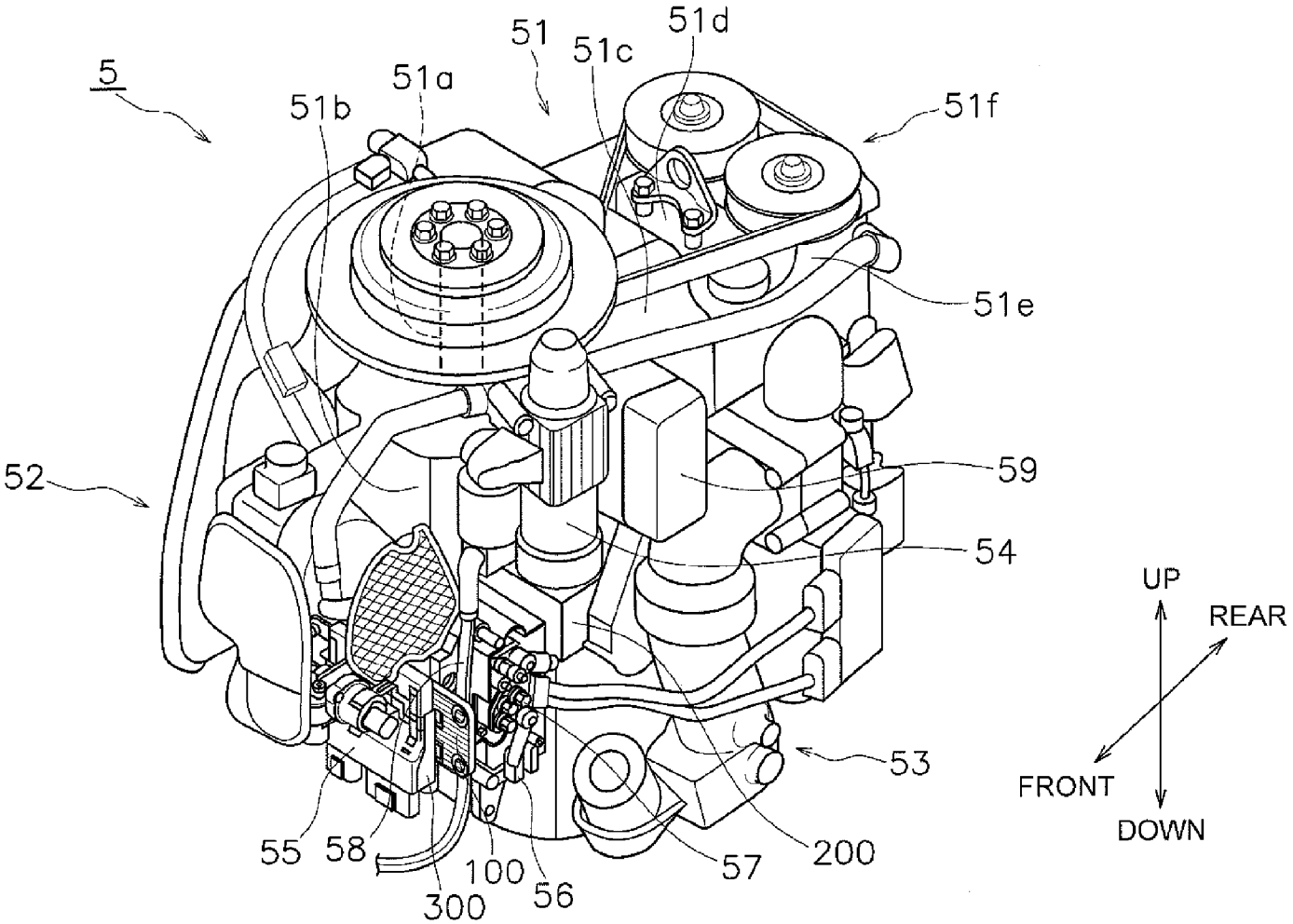
FIG. 2 is a perspective view of an engine unit.
Figure 3:
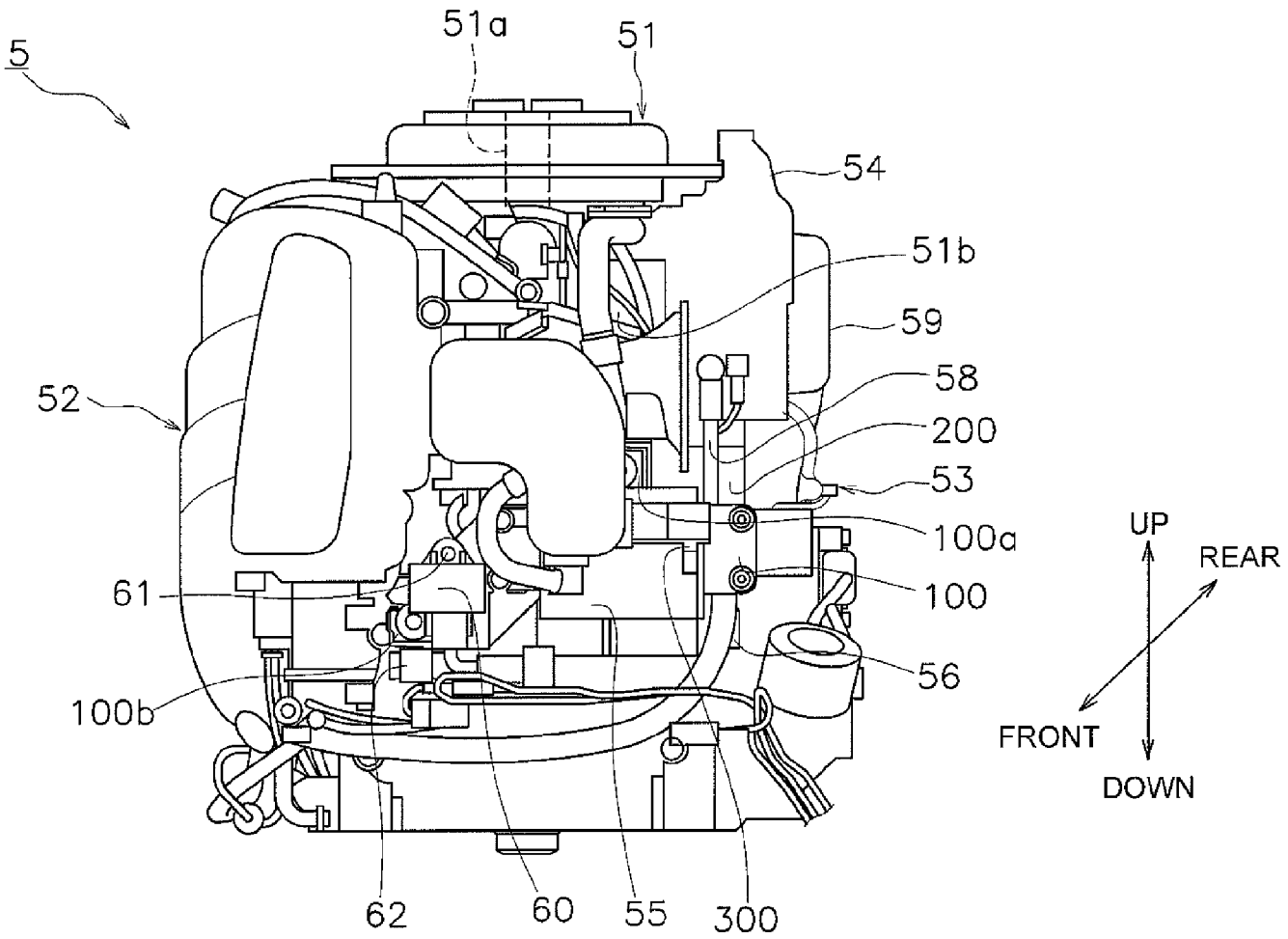
FIG. 3 is a front view of the engine unit.
Figure 4:
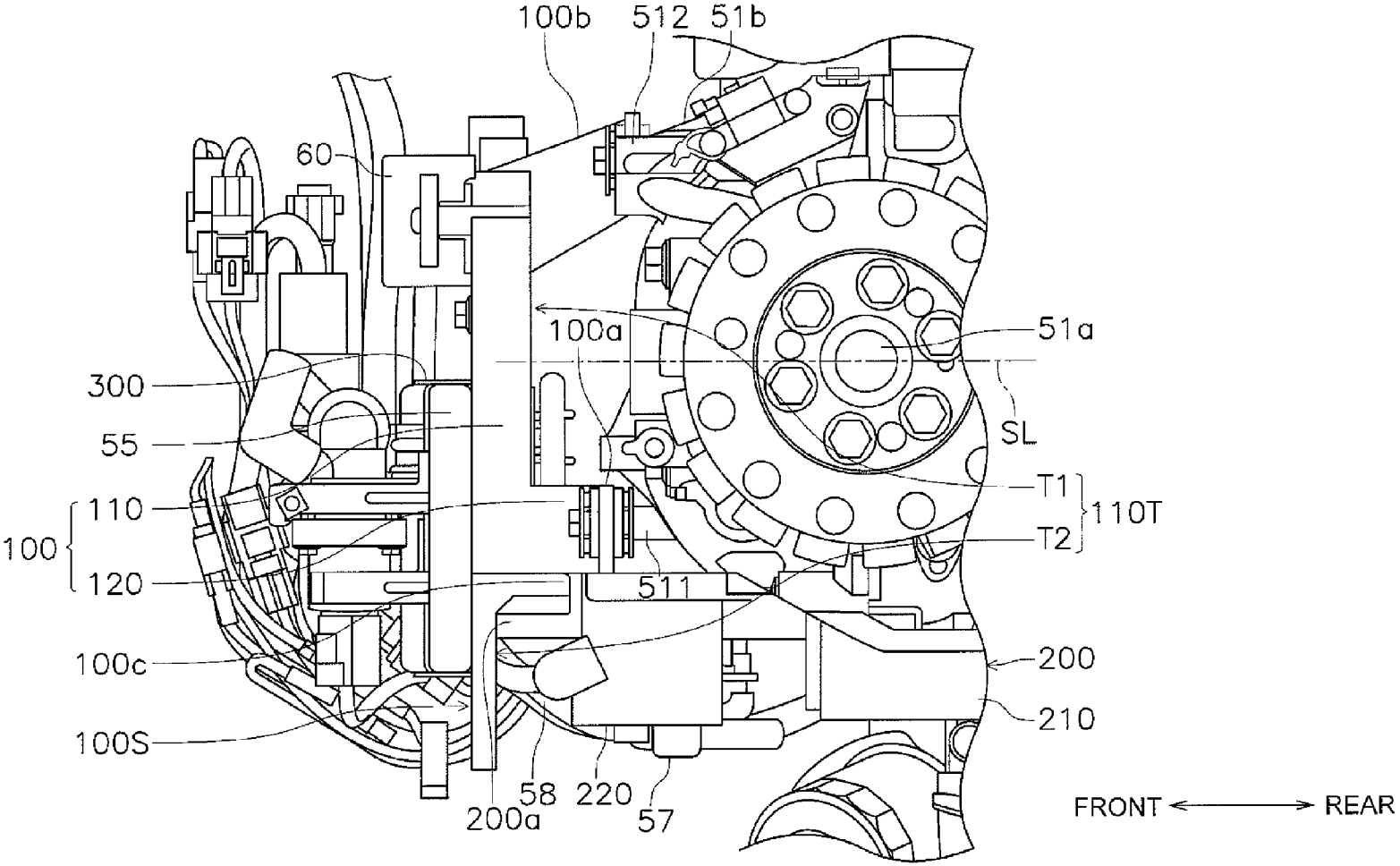
FIG. 4 is a top view of a first bracket and the periphery thereof.
Figure 5:
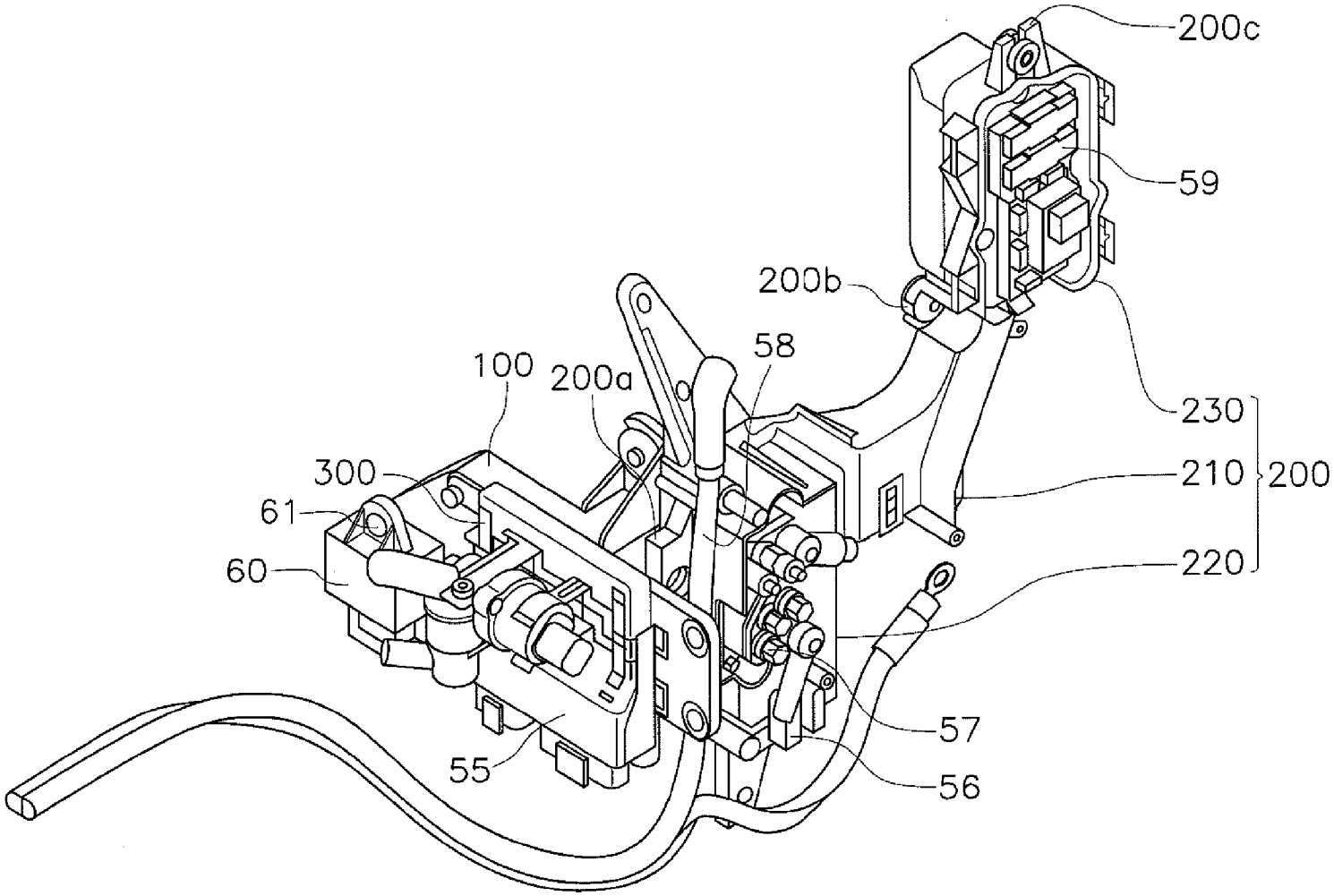
FIG. 5 is a perspective view of the first bracket and the periphery thereof.

FIG. 2 is a perspective view of the engine unit 5. FIG. 3 is a front view of the engine unit 5. FIG. 4 is a top view of a first bracket 100 and the periphery thereof. FIG. 5 is a perspective view of the first bracket 100 and the periphery thereof.

As illustrated in FIGS. 2 and 3, the engine unit 5 includes the engine 51, an intake device 52, an exhaust device 53, a starter motor 54, an ECU (Electronic Control Unit) 55, a starter relay 56, a PTT relay 57, a battery cable 58, a fuse box 59, a main relay 60, a main relay attachment portion 61, a diagnostic connector 62, the first bracket 100, a second bracket 200, and a fixing member 300.

The engine 51 includes the crankshaft 51*a*, a crankcase 51*b*, a cylinder body 51*c*, a cylinder head 51*d*, a head cover 51*e*, and a valve train 51*f*. The crankcase 51*b*, the cylinder body 51*c*, the cylinder head 51*d*, and the head cover 51*e* are aligned from front to rear in this order. A crank chamber configured to accommodate the crankshaft 51*a* is provided inside the crankcase 51*b* and the cylinder body 51*c*. Further, at least one cylinder is provided inside the cylinder body 51*c* and the cylinder head 51*d*. Yet further, a cam chamber is provided inside the cylinder head 51*d* and the head cover 51*e*. The cam chamber accommodates a cam shaft and so forth included in the valve train 51*f*.

The intake device 52 is configured to supply external air to the engine 51. The exhaust device 53 is configured to discharge exhaust gas from the engine 51 to the outside. The starter motor 54 is a motor configured to start the engine 51. The starter motor 54 is fixed to a lateral surface of the cylinder body 51*c* of the engine 51.

The ECU 55 is an exemplary first electric component configured to be attached to the first bracket 100. The ECU 55 is configured and programmed to integrally control the engine 51. For example, the ECU 55 is configured and programmed to regulate the injection amount of fuel. In the present preferred embodiment, the ECU 55 is fixed to a position forward of the first bracket 100 by the fixing member 300. Each of the starter relay 56, the PTT relay 57, and the battery cable 58 is an exemplary second electric component to be disposed between the first bracket 100 and the engine 51. The starter relay 56 is a relay configured to drive the starter motor 54. The PTT relay 57 is a relay configured to drive a PTT (Power Trim and Tilt). As illustrated in FIG. 5, the starter relay 56 and the PTT relay 57 are fixed to the second bracket 200. The battery cable 58 connects a battery (not illustrated in the drawings) and the starter motor 54. As illustrated in FIG. 5, the battery cable 58 is disposed so as to extend up and down between the first bracket 100 and the second bracket 200.

The fuse box 59 accommodates a fuse as an auxiliary electric component for the engine 51. As illustrated in FIG. 5, the fuse box 59 is fixed to the second bracket 200. The main relay 60 is a relay configured to supply electric power to the ECU 55. The main relay 60 is connected to the main relay attachment portion 61 fixed to the first bracket 100. The diagnostic connector 62 is a terminal configured to connect an external diagnostic device (e.g., a personal computer) when diagnosing trouble in the ECU 55.

The first bracket 100 is disposed on the front side of the engine 51. The first bracket 100 is fixed to the engine 51. Specifically, the first bracket 100 is coupled, at a first coupling portion 100*a* and a second coupling portion 100*b*, to the engine 51. As illustrated in FIG. 4, the first coupling portion 100*a* is coupled to a first attachment portion 511 of the crankcase 51*b*. On the other hand, the second coupling portion 100*b* is coupled to a second attachment portion 512 of the crankcase 51*b*. The first and second coupling portions 100*a* and 100*b* are spaced away from each other in both of the up-and-down direction and a direction perpendicular or substantially perpendicular to the up-and-down direction (hereinafter referred to as a horizontal direction).

The first bracket 100 is fixed to the second bracket 200. Specifically, the first bracket 100 is coupled, at a third coupling portion 100*c*, to the second bracket 200. As illustrated in FIG. 4, the third coupling portion 100*c* is coupled to a fourth coupling portion 200*a* of the second bracket 200. In a top view, the first coupling portion 100*a* is located between the second coupling portion 100*b* and the third coupling portion 100*c*.

The first bracket 100 includes a first support portion 110 and a second support portion 120.

The first support portion 110 preferably has a plate shape. The first support portion 110 is disposed so as to extend in the horizontal or substantially horizontal direction. The first support portion 110 includes the second coupling portion 100*b* and the third coupling portion 100*c*. The first support portion 110 includes a first lateral surface 110S and a second lateral surface 110T. The first lateral surface 110S is designed to have a large attachment area such that a large number of electric components or a large-sized electric component may be attached thereto. The ECU 55 is preferably attached to the first lateral surface 110S.

The second lateral surface 110T is disposed opposite to the first lateral surface 110S. As illustrated in FIG. 4, the second lateral surface 110T is preferably divided into a first region T1 and a second region T2 with respect to the second support portion 120. A reference line SL, arranged perpendicular to the first region T1, passes through the crankshaft 51*a*. The reference line SL is a line matched with the axis of the propeller shaft 14 (see FIG. 1) in a top view. The reference line SL is located between the first coupling portion 100*a* and the second coupling portion 100*b*, and between the second coupling portion 100*b* and the third coupling portion 100*c*. The starter relay 56, the PTT relay 57, and the battery cable 58 are disposed between the second region T2 and the engine 51. It should be noted that a line arranged perpendicular to the second region T2 does not pass through the crankshaft 51*a*, although this is not illustrated in the drawings.

As illustrated in FIG. 4, the second support portion 120 protrudes from the second lateral surface 110T of the first support portion 110 toward the engine 51. The second support portion 120 is disposed in a position spaced away from the both ends of the second lateral surface 110T of the first support portion 110. Therefore, the second support portion 120 is spaced away from the both end portions of the first support portion 110. The second support portion 120 is preferably located adjacent to either of the both ends of the second lateral surface 110T, or alternatively, located in the vicinity of the middle portion of the second lateral surface 110T. The second support portion 120 includes the first coupling portion 100*a*. In the present preferred embodiment, the second support portion 120 is preferably integral and unitary with the first support portion 110.

The second bracket 200 is coupled to the first bracket 100 and the engine 51. The second bracket 200 is coupled, at the fourth coupling portion 200*a*, to the third coupling portion 100*c* of the first support portion 110. The fourth coupling portion 200*a* is disposed on the front end portion of the second bracket 200. The second bracket 200 is coupled, at a fifth coupling portion 220*b* and a sixth coupling portion 200*c*, to the crankcase 51*b* of the engine 51. The fifth and sixth coupling portions 200*b* and 200*c* are disposed on the rear end portion of the second bracket 200.

The second bracket 200 includes a main body portion 210, a first accommodation portion 220, and a second accommodation portion 230. The main body portion 210 has an approximate L shape. The main body portion 210 is disposed laterally of the engine 51 so as to extend in the back-and-forth direction. The first accommodation portion 220 is disposed adjacent to the fourth coupling portion 200*a*. As illustrated in FIG. 4, the first accommodation portion 220 is located outward of the second support portion 120 with reference to the reference line SL. The first accommodation portion 220 accommodates the starter relay 56 and the PTT relay 57. The second accommodation portion 230 is disposed adjacent to the fifth and sixth coupling portions 200*b* and 200*c*. The second accommodation portion 230 accommodates the fuse box 59.

The fixing member 300 is locked to the first support portion 110 of the first bracket 100. The fixing member 300 fixes the ECU 55 to the first lateral surface 110S of the first support portion 110.

Figure 6:
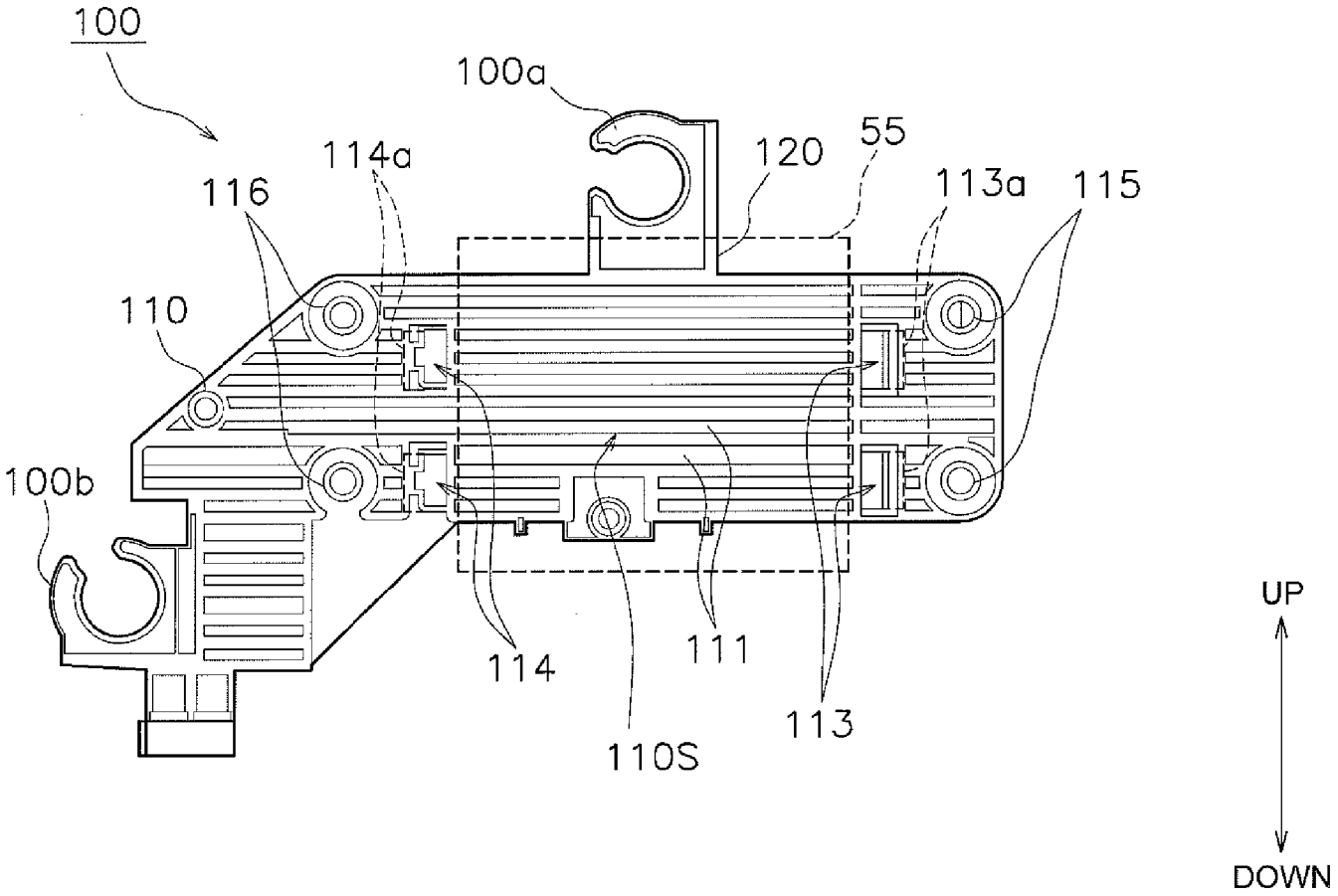
FIG. 6 is a plan view of a first lateral surface of a first support portion.
Figure 7:
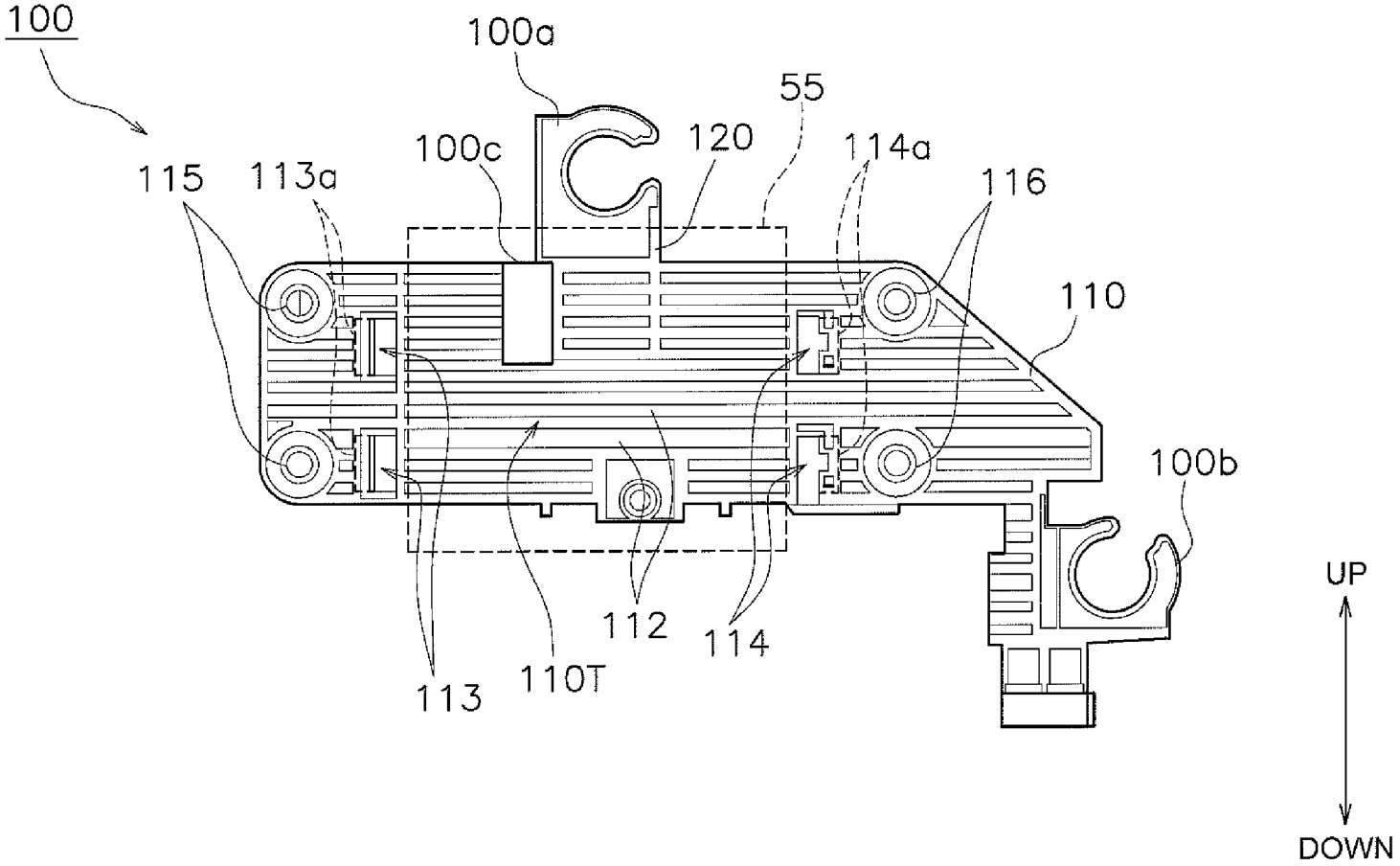
FIG. 7 is a plan view of a second lateral surface of the first support portion.
Figure 8:
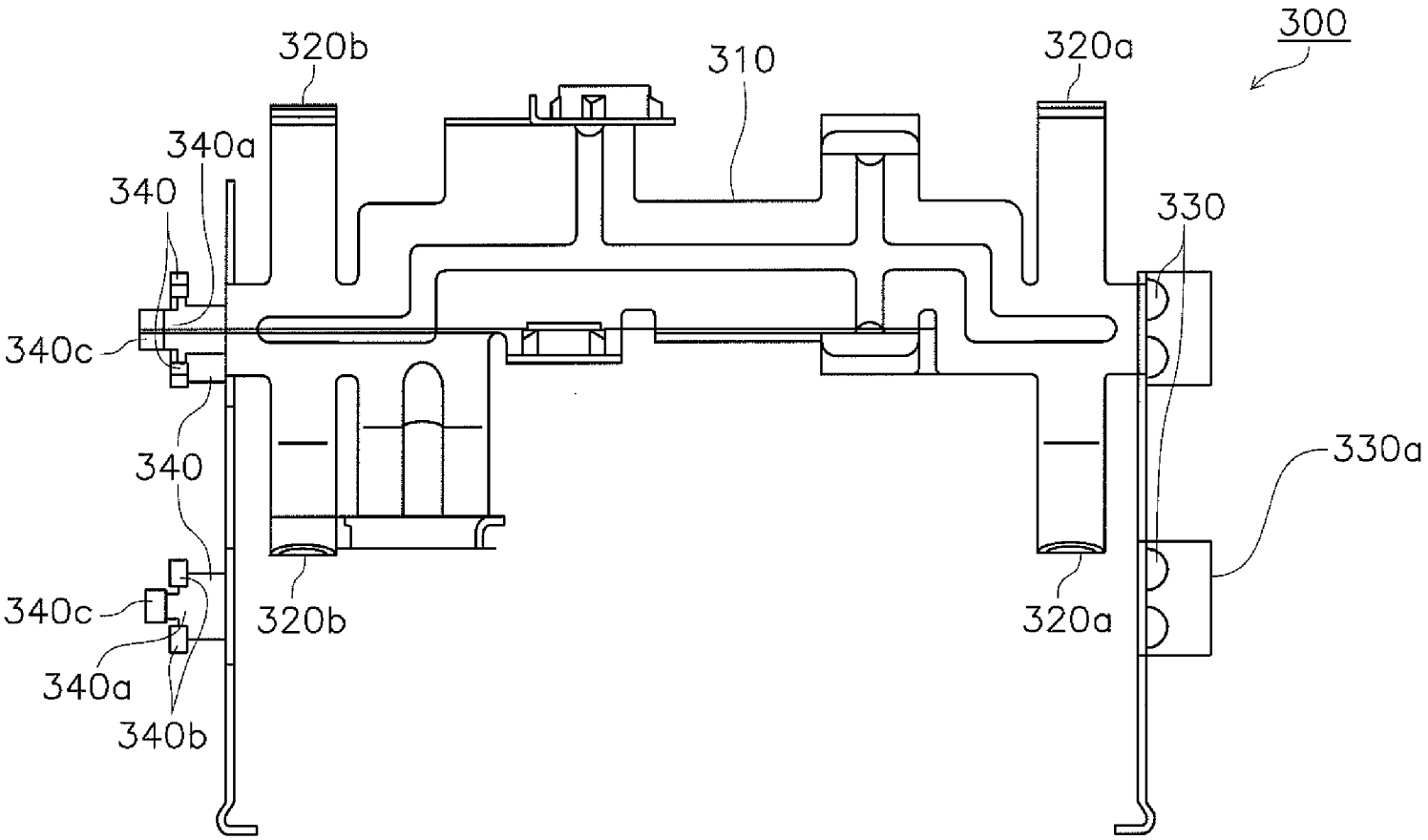
FIG. 8 is a side view of a fixing member.
Figure 9:
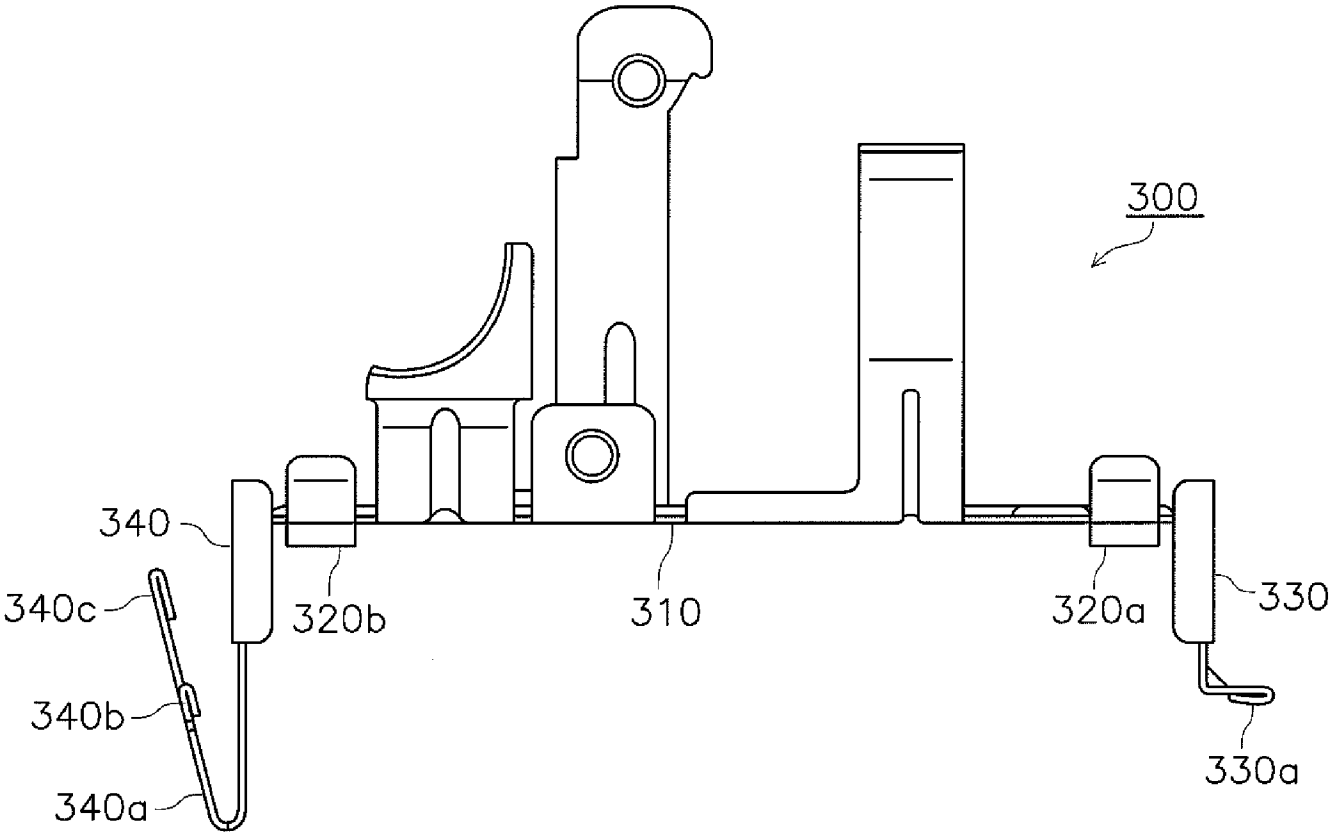
FIG. 9 is a top view of the fixing member.

Detailed explanation will be hereinafter made of the structure of the first bracket 100 and of the fixing member 300. FIG. 6 is a plan view of the first lateral surface 110S of the first support portion 110. FIG. 7 is a plan view of the second lateral surface 110T of the first support portion 110. FIG. 8 is a side view of the fixing member 300. FIG. 9 is a top view of the fixing member 300. The ECU 55 is depicted with a broken line in FIGS. 6 and 7.

As illustrated in FIGS. 6 and 7, the first support portion 110 includes a plurality of first ribs 111, a plurality of second ribs 112, a pair of first recessed portions 113, a pair of second recessed portions 114, a pair of first auxiliary holes 115, and a pair of second auxiliary holes 116.

The plurality of first ribs 111 are provided on the first lateral surface 110S. The first lateral surface 110S extends in the horizontal or substantially horizontal direction. The plurality of second ribs 112 are provided on the second lateral surface 110T. The second ribs 112 extend in the horizontal or substantially horizontal direction.

The pair of first recessed portions 113 and the pair of second recessed portions 114 are located on both sides of the ECU 55 in the plan view of the first lateral surface 110S. The pair of first recessed portions 113 and the pair of second recessed portions 114 are located in positions opposed to each other in the horizontal or substantially horizontal direction.

The pair of first recessed portions 113 is preferably bored, for example, in the first lateral surface 110S. The first recessed portions 113 preferably have a rectangular plan shape. The first recessed portions 113 penetrate through the first support portion 110. However, the first recessed portions 113 may be indented on the first support portion 110. Each of the first recessed portions 113 includes a first lock recess 113*a*. The first lock recesses 113*a* are provided inside the first support portion 110. The first lock recesses 113*a* are recessed opposite to the second recessed portions 114.

The pair of second recessed portions 114 is preferably bored, for example, in the first lateral surface 110S. The second recessed portions 114 preferably have a T-polyomino plan shape. The second recessed portions 114 penetrate through the first support portion 110. However, the second recessed portions 114 may be indented on the first support portion 110. Each of the second recessed portions 114 includes a second lock recess 114*a*. The second lock recesses 114*a* are provided inside the first support portion 110. The second lock recesses 114*a* are recessed opposite to the first recessed portions 113.

The pair of first auxiliary holes 115 and the pair of second auxiliary holes 116 are arranged to receive fixing portions (e.g., bolts) to more rigidly fix the fixing member 300. In the present preferred embodiment, the first auxiliary holes 115 and the second auxiliary holes 116 are designed not to be used.

As illustrated in FIGS. 8 and 9, the fixing member 300 includes a main body portion 310, a pair of first leaf springs 320*a*, a pair of second leaf springs 320*b*, a pair of first convex portions 330, and a pair of second convex portions 340.

The main body portion 310 preferably has a plate shape. The main body portion 310 is disposed along the surface of the ECU 55. The pair of first leaf springs 320*a* and the pair of second leaf springs 320*b* respectively urge the ECU 55 toward the first lateral surface 110S. The pair of first leaf springs 320*a* extend from both the top and bottom sides of the main body portion 310. The pair of second leaf springs 320*b* extend from both the top and bottom sides of the main body portion 310.

The pair of first convex portions 330 and the pair of second convex portions 340 are disposed on the both sides of the ECU 55 in the plan view of the first lateral surface 110S. The pair of first convex portions 330 and the pair of second convex portions 340 are disposed in positions opposite to each other in the horizontal or substantially horizontal direction.

The pair of first convex portions 330 are inserted into the pair of first recessed portions 113 of the first support portion 110. Each of the first convex portions 330 includes a hook portion 330*a* provided on the tip end thereof. The hook portions 330*a* are respectively inserted into the first lock recesses 113*a* of the first recessed portions 113. Accordingly, the pair of first convex portions 330 are locked to the pair of first recessed portions 113.

The pair of second convex portions 340 are inserted into the pair of second recessed portions 114 of the first support portion 110. Each of the second convex portions 340 includes a leaf spring portion 340*a*, a pair of shoulder portions 340*b*, and a knob portion 340*c*. The leaf spring portion 340*a* is inserted into its corresponding second recessed portion 114. The pair of shoulder portions 340*b* are inserted into the second lock recess 114*a* of the corresponding second recessed portion 114 by an urging force of the leaf spring portion 340*a*. Thus, the pair of second convex portions 340 is locked to the pair of second recessed portions 114. The knob portion 340*c* protrudes from the corresponding second recessed portion 114. When the leaf spring portion 340*a* is compressed while the knob portion 340 is held, the pair of shoulder portions 340*b* are configured to be pulled out of the second lock recess 114*a*.

The boat propulsion device 1 according to the various preferred embodiments includes the following features.

The first bracket 100 includes the first support portion 110 and the second support portion 120. The first support portion 110 includes the first lateral surface 110S to which the ECU 55 is attached, and the second lateral surface 110T disposed opposite to the first lateral surface 110S. The second support portion 120 is connected to the second lateral surface 110T in a position spaced away from the both ends of the second lateral surface 110T in a top view. The second support portion 120 includes the first coupling portion 110*a* configured to be coupled to the engine 51.

Figure 10:
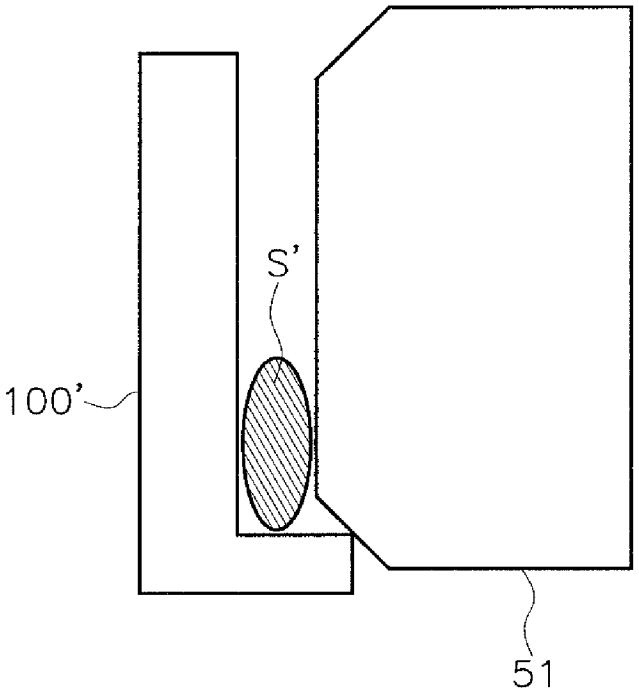
FIG. 10 PRIOR ART
FIG. 10 is a schematic diagram of a well-known structure.

Therefore, it is possible to provide a large area to attach an electric component on the first lateral surface 110S and to provide an externally accessible space on the outside of the second support portion 120 with reference to the reference line SL (see FIG. 4). Specifically as illustrated in FIG. 10, when using an L-shaped bracket 110' that has been well-known, an externally inaccessible space S' is inevitably produced between the engine 51 and the L-shaped bracket 100'. On the other hand, when using the first bracket 100 according to the present preferred embodiment, an externally accessible space S is provided between the engine 51 and the first bracket 100 (specifically, the second region T2 of the second lateral surface 110T).

The first support portion 110 includes the second coupling portion 100*b* configured to be coupled to the engine 51. Thus, the first support portion 110 is supported by the second coupling portion 100*b*, while the second support portion 120 is supported by the first coupling portion 100*a*. Therefore, the support strength of the first bracket 100 is enhanced.

The first support portion 110 includes the third coupling portion 100*c* configured to be coupled to the second bracket 200. The first coupling portion 100*a* is located between the second coupling portion 100*b* and the third coupling portion 100*c* in the top view. Thus, the first support portion 110 is supported at three points and is well balanced. Therefore, the support strength of the first bracket 100 is further enhanced.

Figure 11:
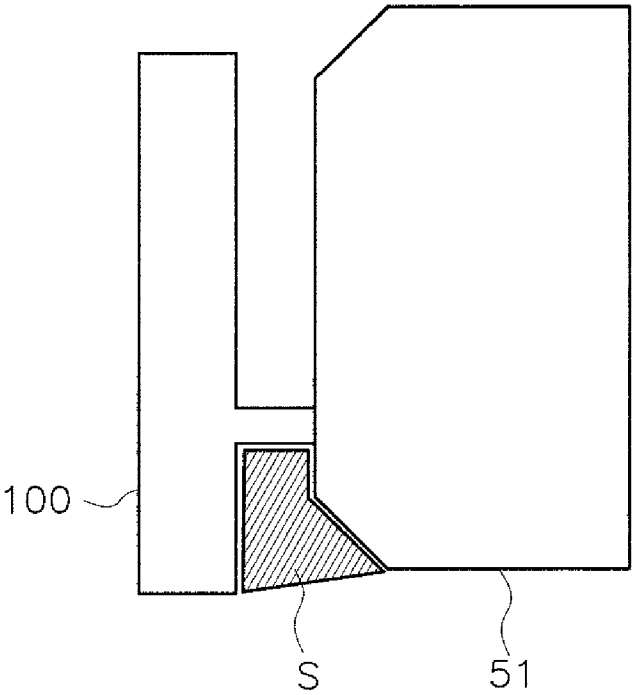
FIG. 11 is a schematic diagram of a structure according to a preferred embodiment of the present application.

The starter relay 56, the PTT relay 57, and the battery cable 58 are disposed between the second region T2 and the engine 51. Thus, the externally accessible space (see "the space S" in FIG. 11) is effectively utilized, and workability during assembly is enhanced.

The first support portion 110 includes the plurality of first ribs 111 extending horizontally or substantially horizontally and the plurality of second ribs 112 extending horizontally or substantially horizontally. Therefore, the strength of the first support portion 110 is enhanced.

The fixing member 300 includes the pair of first leaf springs 320*a* and the pair of second leaf springs 320*b*. The pair of first leaf springs 320*a* and the pair of second leaf springs 320*b* respectively urge the ECU 55 toward the first lateral surface 110S. The ECU 55 is thus held easily, conveniently, and securely.

The first support portion 110 includes the pair of first recessed portions 113 and the pair of second recessed portions 114. The fixing member 300 includes the pair of first convex portions 330 and the pair of second convex portions 340. The pair of first convex portions 330 are inserted into the pair of first recessed portions 113. The pair of second convex portions 340 are inserted into the pair of second recessed portions 114. Each second convex portion 340 includes the leaf spring portion 340*a* to be locked to its corresponding second recessed portion 114. The fixing member 300 is thus fixed to the first support portion 110 easily, conveniently, and securely. Incidentally, when the fixing member 300 is fixed by bolts, the tip ends of the bolts inevitably protrude from the second lateral surface 110T. By contrast, in the structure of the present preferred embodiment, members do not protrude from the second lateral surface 110T. Therefore, it is easy to provide a large space between the second lateral surface 110T and the engine 51.

Preferred embodiments of the present invention have been explained above. However, the present invention is not limited to the preferred embodiments described above, and a variety of changes may be made without departing from the scope of the present invention.

In the aforementioned exemplary preferred embodiments, the ECU 55 has been exemplified as the first electric component to be attached to the first bracket 100. However, instead of or in addition to the ECU 55, another electric component may be provided as the first electric component.

In the preferred embodiments described above, the starter relay 56, the PTT relay 57, and the battery cable 58 have been exemplified as second electric components to be disposed between the engine 51 and the second region T2 of the second lateral surface 110T. However, instead of or in addition to these electric components, other electric components may be provided as the second electric component.

In the preferred embodiments described above, the first bracket 100 is preferably designed to be disposed forward of the engine 51. However, the first bracket 100 may be arbitrarily disposed as long as it is disposed in the area surrounding of the engine 51.

In the preferred embodiments described above, the first bracket 100 is preferably designed to be supported by the second bracket 200. However, the first bracket 100 may be spaced away from the second bracket 200. Further, the engine unit 5 may not include the second bracket 200.

In the preferred embodiments described above, the first support portion 110 of the first bracket 100 is preferably designed to include the plurality of first ribs 111 and the plurality of second ribs 112. However, the first support portion 110 is only required to include at least either the plurality of first ribs 111 or the plurality of second ribs 112.

In the preferred embodiments described above, the first support portion 110 of the first bracket 100 is preferably designed to include the pair of first recessed portions 113 and the pair of second recessed portions 114. However, the first support portion 110 is only required to include one first recessed portion 113 and one second recessed portion 114. In this structure, the fixing member 300 is only required to include one first convex portion 330 and one second convex portion 340.

In the preferred embodiments described above, the term "locked" means a condition that a first member and a second member are interlocked or fixed with each other. Therefore, the shape of the first lock recesses 113*a* and that of the second lock recesses 114*a* are not limited to those illustrated in the drawings. The first lock recesses 113*a* and the second lock recesses 114*a* may have any arbitrary shape as long as the first convex portions 330 and the second convex portions 340 are respectively locked thereto.

In the preferred embodiments described above, the term "urged" means either a condition that a first member is pressed onto a second member or a condition that the first member is pulled toward the second member. Therefore, the pair of first leaf springs 320*a* and the pair of second leaf springs 320*b* are not limited to leaf springs. Arbitrary members may be used as the pair of first leaf springs 320*a* and the pair of second leaf springs 320*b* as long as such members are configured to either press the ECU 55 onto the first support portion 110 or pull the ECU 55 toward the first support portion 110.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A boat propulsion device comprising:

an engine including a crankshaft extending in an up-and-down direction;

a first bracket fixed to the engine; and a first electric component attached to the first bracket; wherein the first bracket includes a first support portion and a second support portion;

the first support portion includes a first lateral surface and a second lateral surface, the first electric component is attached to the first lateral surface, and the second lateral surface is arranged opposite to the first lateral surface; and the second support portion is connected to the second lateral surface in a position spaced away from both ends of the second lateral surface in a top view, and the second support portion includes a first coupling portion coupled to the engine.

2. The boat propulsion device according to claim 1, wherein the first support portion includes a second coupling portion coupled to the engine.

3. The boat propulsion device according to claim 2, further comprising:

a second bracket coupled to the first bracket and to the engine; wherein the first bracket includes a third coupling portion coupled to the second bracket; and the first coupling portion is located between the second coupling portion and the third coupling portion in the top view.

4. The boat propulsion device according to claim 1, further comprising:

a second electric component different from the first electric component; wherein the second lateral surface includes a first region and a second region with respect to the second support portion in the top view;

a reference line perpendicular to the first region passes through the crankshaft; and the second electric component is disposed between the second region and the engine.

5. The boat propulsion device according to claim 1, wherein the first support portion includes a plurality of ribs on at least one of the first lateral surface and the second lateral surface.

6. The boat propulsion device according to claim 5, wherein the first support portion is a plate-shaped member extending in a horizontal or substantially horizontal direction perpendicular or substantially perpendicular to the up-and-down direction; and the plurality of ribs extend in the horizontal or substantially horizontal direction.

7. The boat propulsion device according to claim 1, further comprising:

a fixing member configured to fix the first electric component to the first lateral surface; wherein the fixing member includes a leaf spring configured to urge the first electric component toward the first lateral surface.

8. The boat propulsion device according to claim 7, wherein the first support portion includes a first recessed portion and a second recessed portion, and the first and second recessed portions are located on both sides of the first electric component in a plan view of the first lateral surface;

the fixing member includes a first convex portion inserted into the first recessed portion and a second convex portion inserted into the second recessed portion; and the second convex portion includes a leaf spring locked to an inside of the second recessed portion.

* * * * *